US007669965B2

(12) United States Patent
Silverbrook

(10) Patent No.: US 7,669,965 B2
(45) Date of Patent: Mar. 2, 2010

(54) ALIGNMENT MECHANISM FOR A PRINTHEAD MODULE

(75) Inventor: Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 934 days.

(21) Appl. No.: 10/986,813

(22) Filed: Nov. 15, 2004

(65) Prior Publication Data

US 2005/0062829 A1 Mar. 24, 2005
US 2008/0007607 A9 Jan. 10, 2008

Related U.S. Application Data

(63) Continuation of application No. 10/804,048, filed on Mar. 19, 2004, now Pat. No. 7,322,675, which is a continuation of application No. 10/636,286, filed on Aug. 8, 2003, now Pat. No. 6,739,701, which is a continuation of application No. 10/129,433, filed as application No. PCT/AU01/00217 on Mar. 2, 2001, now Pat. No. 6,672,707.

(30) Foreign Application Priority Data

Mar. 2, 2000 (AU) ..... PQ5957

(51) Int. Cl.
*B41J 2/155* (2006.01)
*B41J 2/14* (2006.01)
*B41J 2/16* (2006.01)

(52) U.S. Cl. ..... 347/42; 347/49

(58) Field of Classification Search ..... 347/13, 347/42, 49

See application file for complete search history.

(56) References Cited

U.S. PATENT DOCUMENTS 5,016,023 A * 5/1991 Chan et al. ..... 347/42
5,057,854 A 10/1991 Pond et al.
5,148,194 A 9/1992 Asai et al.
5,160,945 A 11/1992 Drake
5,297,017 A 3/1994 Haselby et al.
5,488,397 A 1/1996 Nguyen et al.
5,696,541 A * 12/1997 Akahane et al. ..... 347/8
5,850,240 A 12/1998 Kubatzki et al.
6,000,782 A 12/1999 Lee
6,068,367 A 5/2000 Fabbri
6,270,184 B1 * 8/2001 Igarashi et al. ..... 347/37

(Continued)

FOREIGN PATENT DOCUMENTS

EP 0379151 A 7/1990

(Continued)

*Primary Examiner*—Matthew Luu
*Assistant Examiner*—Lisa Solomon

(57) ABSTRACT

An alignment mechanism for a printhead includes a support frame into which there is formed a printhead module mounting plate. The mounting plate is coupled to a lever at one side of the lever's fulcrum point. A grub screw is captured by a portion of the mounting frame and rotatably received at a point on the lever at an opposite side of the fulcrum to the mounting plate coupling point. The fulcrum point is located closer to the mounting plate than to the grub screw. Rotation of the grub screw causes minute movement of the mounting plate. A number of hinged arms are also provided which interconnect the mounting plate and the frame and are arranged to facilitate linear movement of the mounting plate in response to adjustment of the grub screw.

10 Claims, 7 Drawing Sheets

U.S. PATENT DOCUMENTS

| | | | | |
|---|---|---|---|---|
| 6,290,332 | B1 | 9/2001 | Crystal et al. | |
| 6,575,557 | B2 * | 6/2003 | Tominaga | 347/37 |
| 6,672,707 | B2 | 1/2004 | Silverbrook | |
| 2002/0024554 | A1 | 2/2002 | Tominaga | |

FOREIGN PATENT DOCUMENTS

| | | | |
|---|---|---|---|
| EP | 0391570 | A | 10/1990 |
| EP | 0710005 | A | 5/1996 |
| GB | 2 306 669 | | 5/1997 |
| JP | 11-352598 | | 12/1999 |
| WO | WO-99/18487 | | 4/1999 |
| WO | WO-99/50787 | | 10/1999 |

* cited by examiner

ALIGNMENT MECHANISM FOR A PRINTHEAD MODULE

CROSS-REFERENCE TO RELATED APPLICATIONS

The present Application is a Continuation of U.S. application Ser. No. 10/804,048 filed on Mar. 19, 2004, now issued U.S. Pat. No. 7,322,675, which is a Continuation of U.S. application Ser. No. 10/636,286, filed on Aug. 8, 2003, now issued U.S. Pat. No. 6,739,701, which is a Continuation of U.S. application Ser. No. 10/129,433, filed on May 6, 2002, now issued U.S. Pat. No. 6,672,707, which is a national phase of PCT/AU01/00217, filed on Mar. 2, 2001.

FIELD OF THE INVENTION

The present invention relates to inkjet printers and in particular to pagewidth inkjet printers.

CO-PENDING APPLICATIONS

Various methods, systems and apparatus relating to the present invention are disclosed in the following co-pending applications filed by the applicant or assignee of the present invention on May 24, 2000:

| | | |
|---|---|---|
| PCT/AU00/00578 | PCT/AU00/00579 | PCT/AU00/00581 |
| PCT/AU00/00580 | PCT/AU00/00582 | PCT/AU00/00587 |
| PCT/AU00/00588 | PCT/AU00/00589 | PCT/AU00/00583 |
| PCT/AU00/00593 | PCT/AU00/00590 | PCT/AU00/00591 |
| PCT/AU00/00592 | PCT/AU00/00584 | PCT/AU00/00585 |
| PCT/AU00/00586 | PCT/AU00/00594 | PCT/AU00/00595 |
| PCT/AU00/00596 | PCT/AU00/00597 | PCT/AU00/00598 |
| PCT/AU00/00516 | PCT/AU00/00517 | PCT/AU00/00511 |

The disclosures of these co-pending applications are incorporated herein by cross-reference. Also incorporated by cross-reference, is the disclosure of a co-filed PCT application, PCT/AU01/00216 (deriving priority from Australian Provisional Patent Application No. PQ5959).

BACKGROUND OF THE INVENTION

The printheads used by inkjet printers traditionally traverse back and forth within the printer as a page is fed past the printhead. To increase printing speed, pagewidth printheads have been developed so that the printhead does not need to traverse across the page.

For a number of reasons, it is relatively expensive to produce pagewidth printheads in a unitary form. Therefore, to minimize costs it is preferable to produce a modular pagewidth printhead made up of a series of printhead modules.

It is necessary to align each module so that the printing from one module precisely abuts the printing from the adjacent modules. For most types of printing, it is sufficient to electronically align the modules. This is done by configuring the modules such that they slightly overlap with each other, and then digitally adjusting the printing from each module for a smooth transition of the print data.

Unfortunately, this requires complex manipulation of the print data allocated to the respective modules. The digital controller for the printer needs to be relatively powerful to accommodate this and the associated costs can be prohibitive for the SOHO (small office/home office) market.

SUMMARY OF THE INVENTION

Accordingly, the present invention provides a modular printhead for a digital printer, the modular printhead including:

a support frame and a plurality of printhead modules, the frame having a plurality of mounting sites for mounting respective printhead modules to the frame; wherein, at least one of the mounting sites has an adjustment mechanism for reducing input movements to effect minute adjustments of the position of the printhead module with respect to the frame.

A modular printhead mounting for a digital printer including:

a support frame;

a plurality of mounting sites, each mounting a print head module;

at least one of the mounting sites including:

a module engagement plate upon which the printhead module is mounted, the module engagement plate being connected to the support frame by flexible arms, said flexible arms constraining said plate to substantially linear movement relative to the frame; and an adjustment mechanism, the adjustment mechanism including:

a lever arm pivotally attached to the frame and also attached to said plate remote from an effective fulcrum wherein pivotal movement of the lever arm causes movement of said plate; and a movable member in engagement with the lever arm causing said pivotal movement of the lever arm.

Preferably, the adjustment mechanism uses a system of levers and pivots for geared reduction of the input movements to minute adjustments of the printhead module relative to the frame. In a further preferred form, the ratio of input movement to the resultant adjustment is at least 500 to 1.

In a particularly preferred form, the movement of the printhead module relative to the frame is less than 100 μm.

In some embodiments, the adjustment mechanism includes an input lever fulcrumed against the support frame for acting on a module engagement plate, the module engagement plate being connected to the support frame by hinged link arms such that the resultant movement of the plate is substantially linear. Preferably, the movement of the input lever is substantially normal to the resultant movement of the engagement plate. In a further preferred form, the input lever for each of the adjustment mechanisms is actuated by a respective grub screw threadedly engaged with the support frame. Conveniently, the ratio of axial movement of the grub screw to the movement of the plate is about 1000 to 1.

Conveniently, the adjustment mechanism is integrally formed with the frame wherein the fulcrum and hinged connections are formed by localized necks in the frame material.

BRIEF DESCRIPTION OF THE DRAWINGS

A preferred embodiment of the invention will now be described by way of example only with reference to the accompanying drawings in which.

DETAILED DESCRIPTION OF THE PREFERRED EMBODIMENTS

Figure 1:
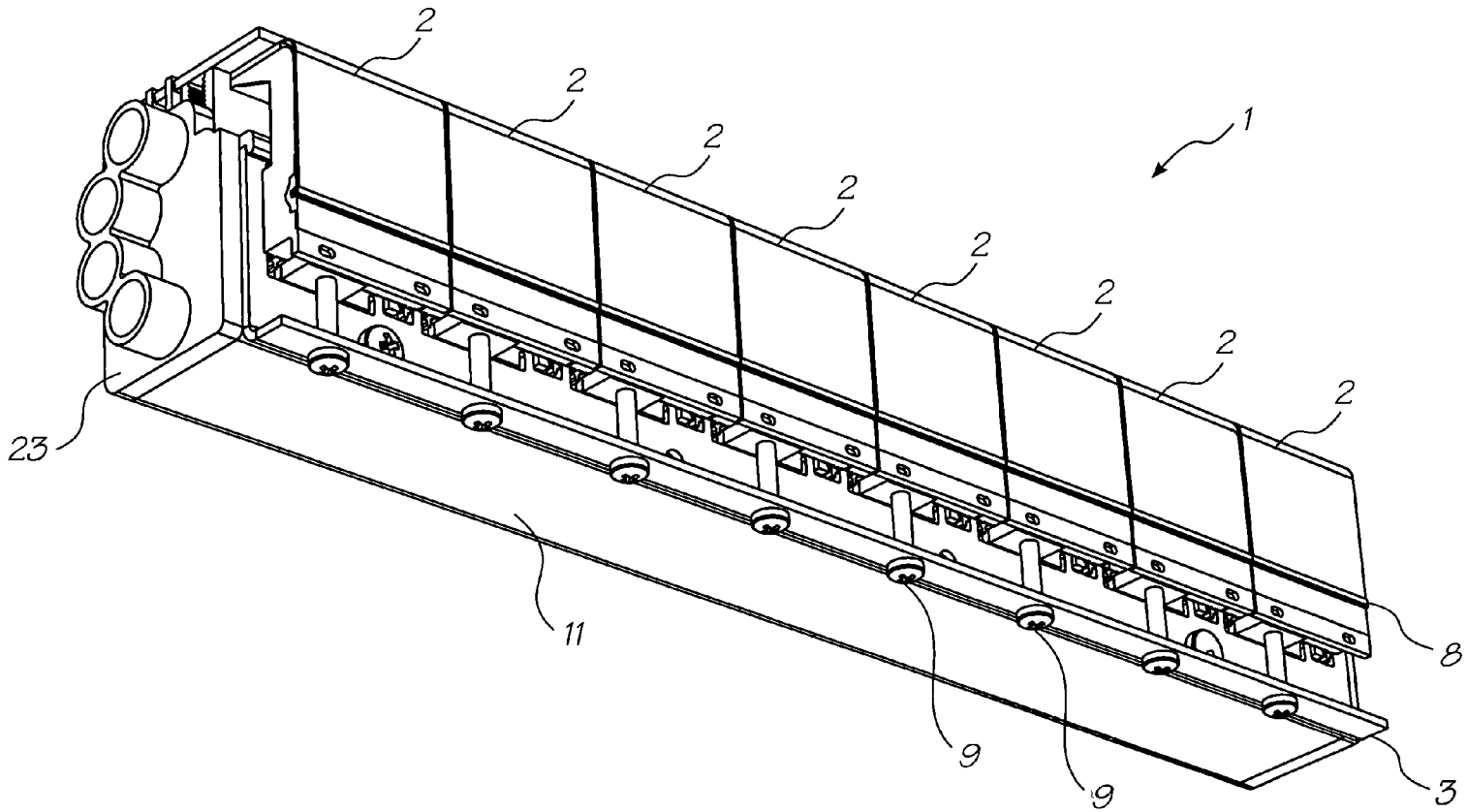
FIG. 1 shows a perspective view of the underside of a modular printhead according to the present invention.
Figure 2:
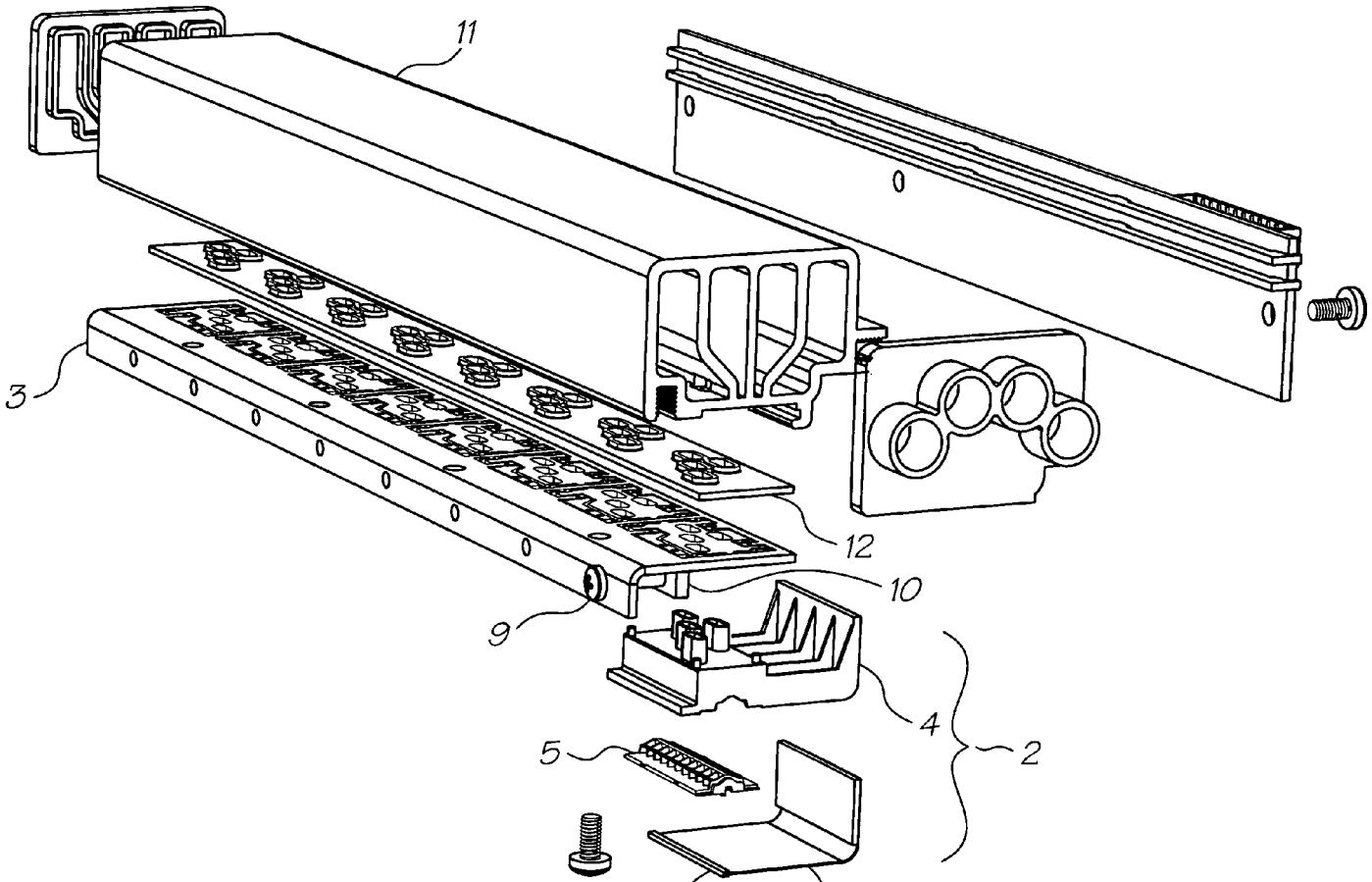
FIG. 2 shows an exploded perspective view of the modular printhead shown in FIG. 1.

Referring to the figures, the modular printhead (1) includes a plurality of printhead modules (2) mounted to a metal chassis (3) which acts as a support frame. The modules (2) are sealed units with four independent ink chambers that feed the inkjet nozzles in a printhead chip (8). As best seen in FIG. 2, each printhead module (2) is plugged into a reservoir moulding (11) that supplies the ink through a self sealing elastomeric strip (12). The entire modular printhead (1) may itself be a module of a larger printhead having two levels of modularity. Accordingly, the length of the overall printhead is arbitrary.

Figure 7:
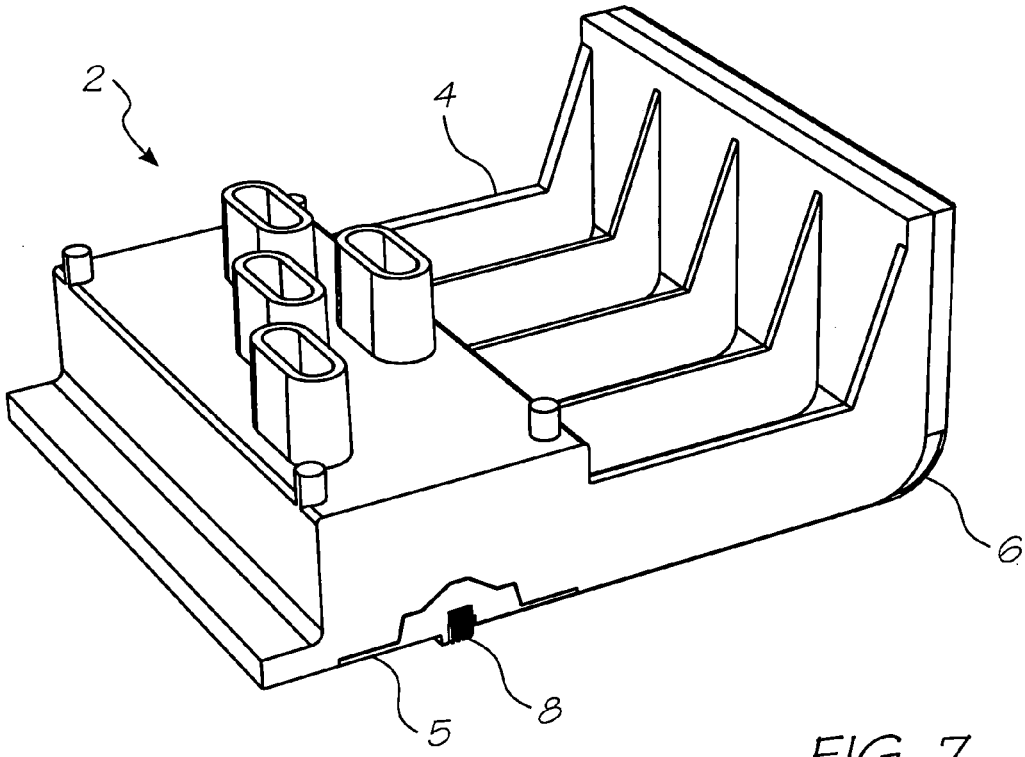
FIG. 7 is a perspective view showing the top and side of a printhead module.
Figure 8:
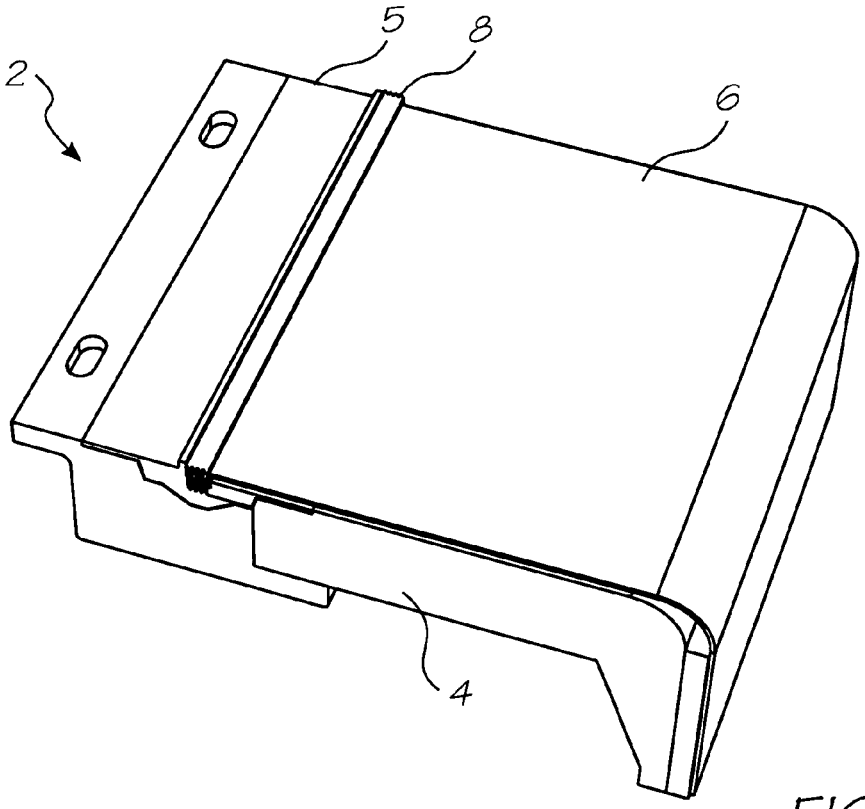
FIG. 8 is a perspective view showing the underside of a printhead module.
Figure 9:
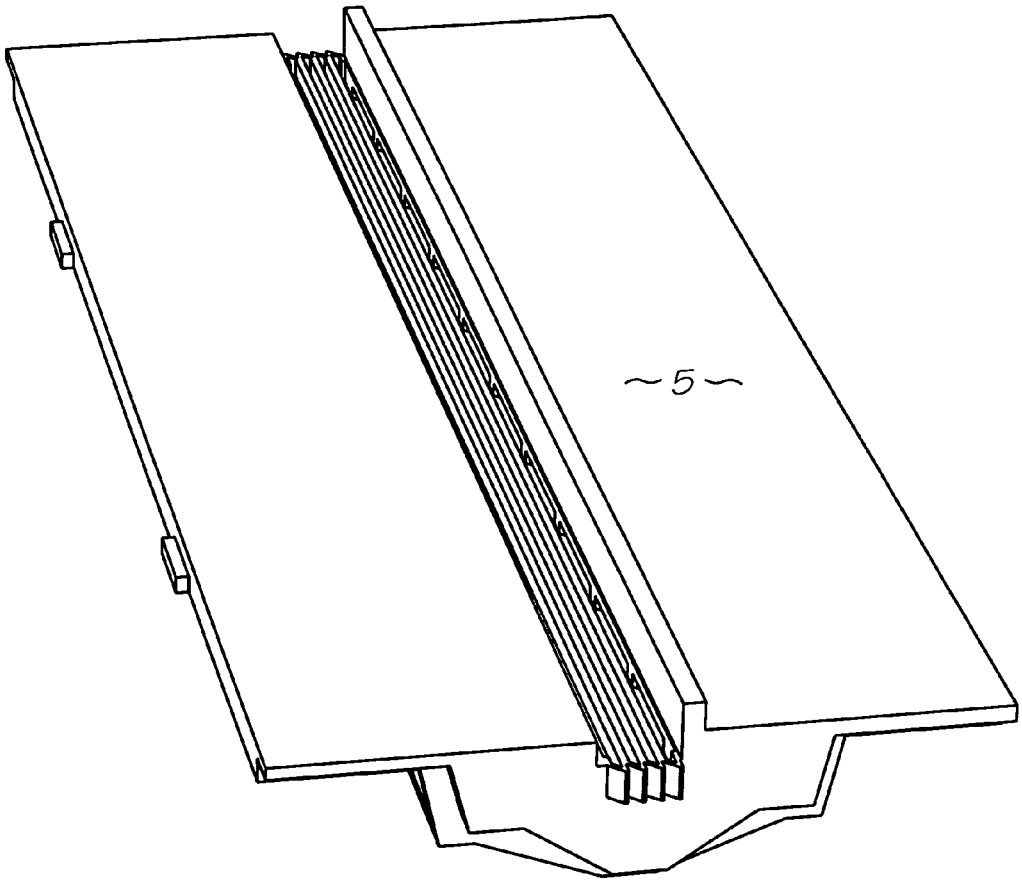
FIG. 9 shows a perspective view of the micro moulding that houses the printing chip in each printhead module.

Referring to FIGS. 7 to 9, the printhead modules (2) each comprise a printhead chip (8) bonded to a TAB (tape automated bond) film (6) accommodated and supported by a micro moulding (5), which is in turn adapted to mate with the cover moulding (4). The printhead chip (8) is typically a micro electro mechanical system(s) (MEMS) device.

The present invention will now be described with particular reference to the Applicant's MEMJET™ technology, various aspects of which are described in detail in the cross referenced documents. It will be appreciated that MEMJET™ is only one embodiment of the invention and used here for the purposes of illustration only. It is not to be construed as restrictive or limiting in any way on the extent of the broad inventive concept.

A MEMJET™ printhead is composed of a number of identical printhead modules (2) described in greater detail below. A MEMJET™ printhead is a drop-on-demand 1600 dpi inkjet printer that produces bi-level dots in up to 6 colors to produce a printed page of a particular width. Since the printhead prints dots at 1600 dpi (dots per inch), each dot is approximately 22.5 μm in diameter, and the dots are spaced 15.875 μm apart. Because the printing is bi-level, the input image is typically dithered or error-diffused for best results.

The modules (2) are designed such that the printhead chips (8) of adjacent modules can exactly abut one another so that there are no gaps or overlap in the printing produced. To achieve this, the modules (2) must be precisely aligned with each other after being mounted on the metal chassis (1).

Aligning the modules (2) using digital control of the chips (8) is possible but relatively difficult and costly given the complex manipulation of the print data necessary to seamlessly join the printing from adjacent modules. The required degree of alignment can be cost effectively provided by the mechanical adjustment mechanism of the present invention.

Figure 3:
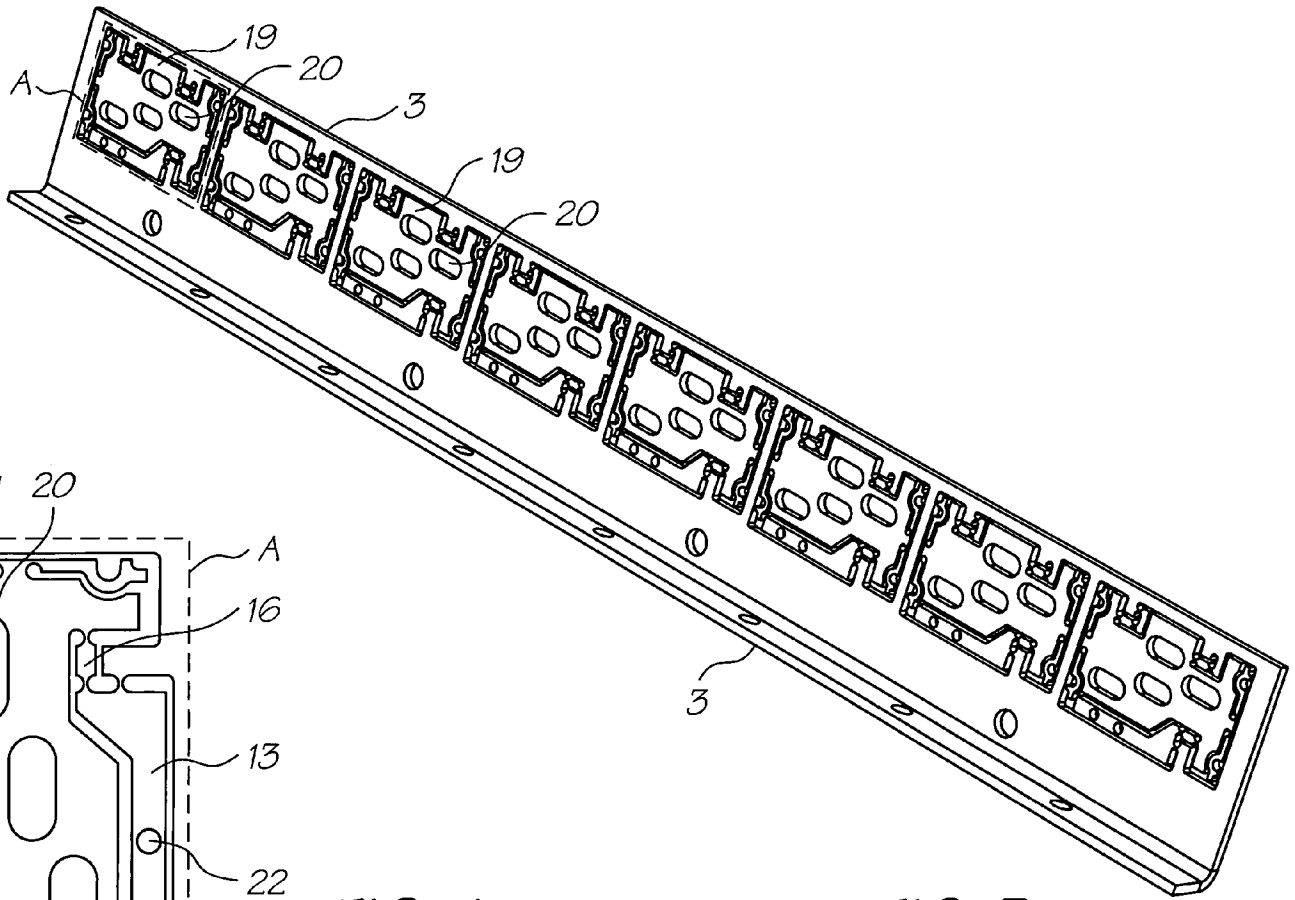
FIG. 3 is a perspective view of the support frame for the modular printhead shown in FIG. 1.
Figure 4:
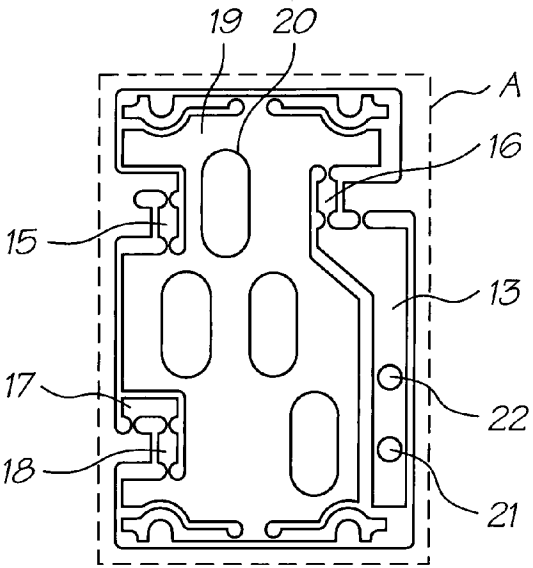
FIG. 4 is a plan view of the adjustment mechanism for one of the printhead modules shown in FIG. 1.
Figure 5:
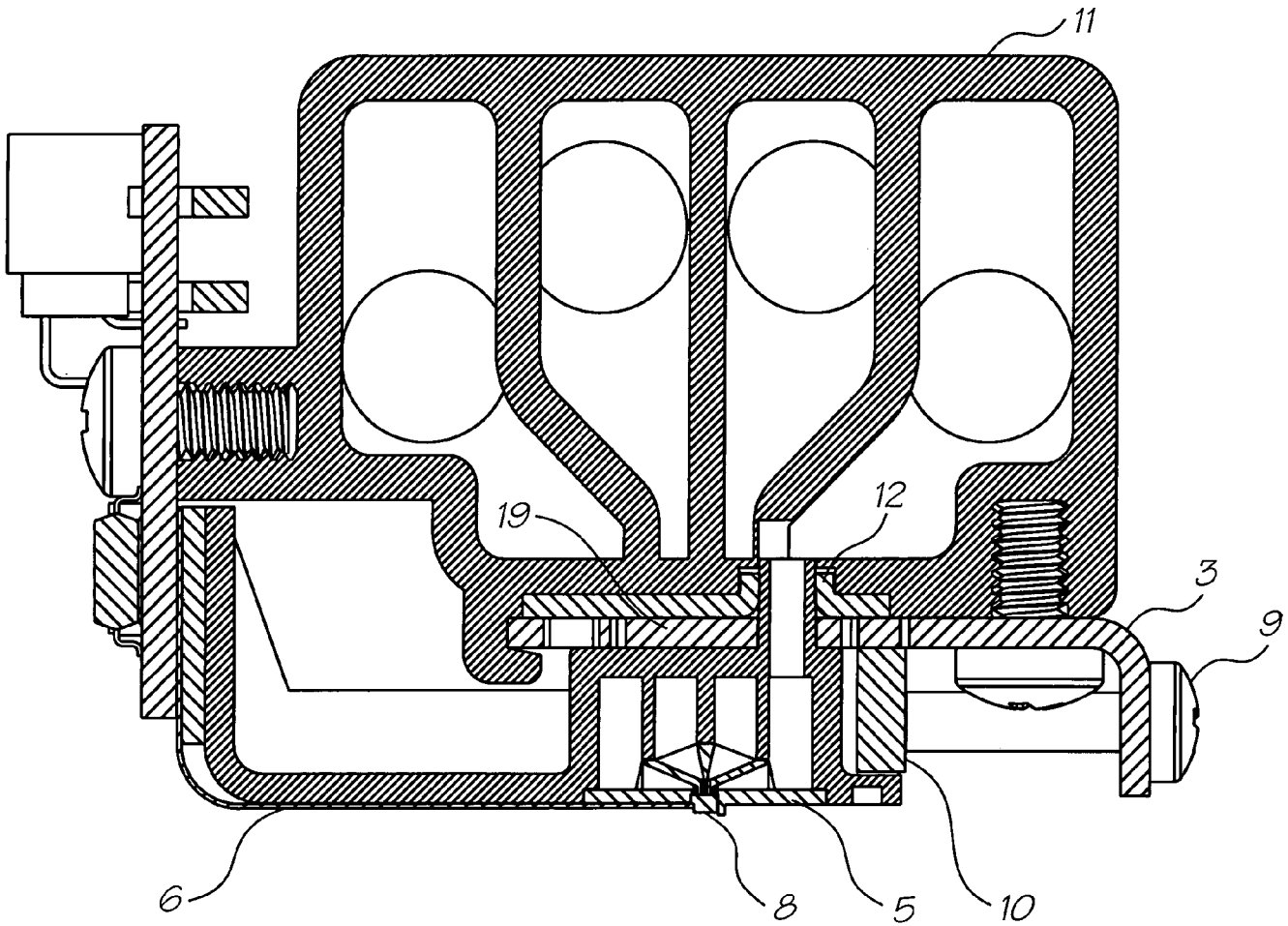
FIG. 5 is a cross-sectional view of the modular printhead shown in FIG. 1.
Figure 6:
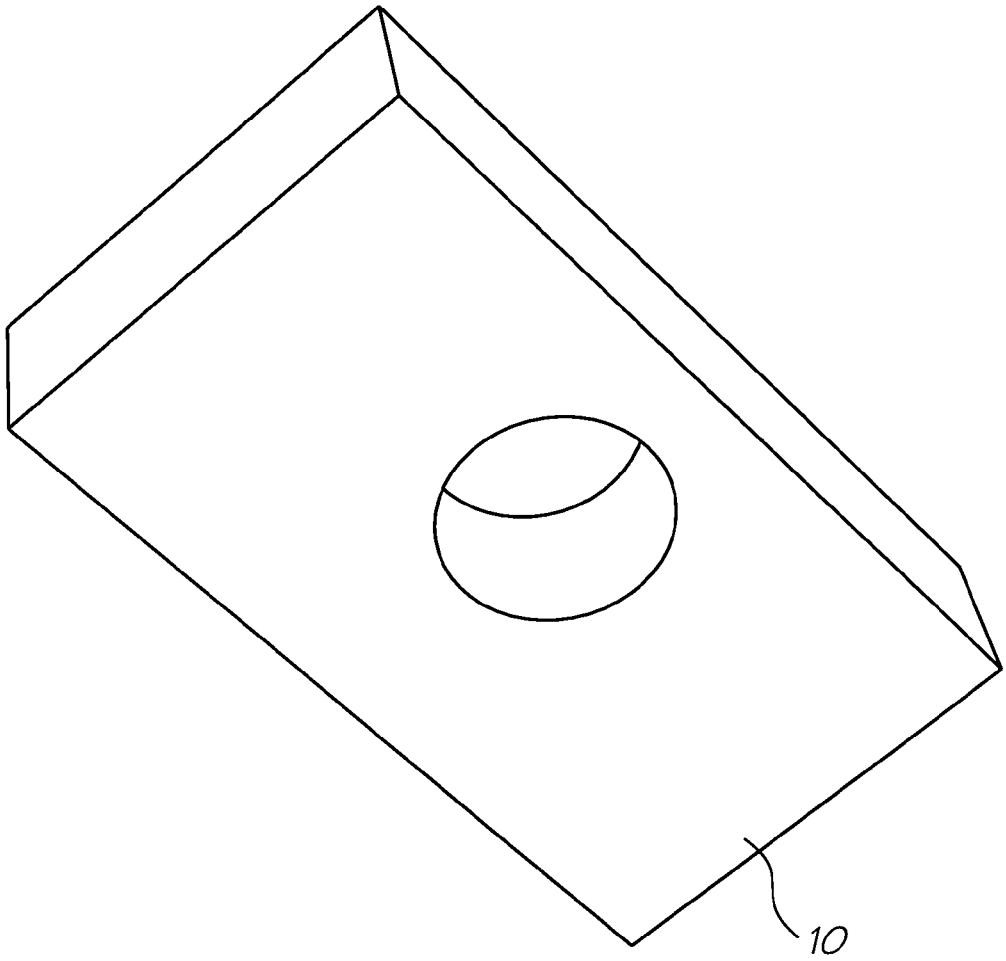
FIG. 6 is a perspective view of the adjuster block shown in FIG. 2.

Referring to FIGS. 3 and 4, the apertures (20) in the module engagement plate (19) receive the ink funnels for each module (2). The engagement plate (19) is integrally formed with the metal chassis (3) via hinged arms (15, 16, 17 & 18). Input lever (13) is fulcrumed against the metal chassis (3) to act on the engagement plate (19) via the hinged link arm (16). Movement of the input lever (13) is reduced by the lever arms to produce a minute movement of the engagement plate (19).

By careful configuration of the input lever (13) and the hinged link arms (15, 16, 17 & 18), the resultant movement in the engagement plate (19) is substantially linear and parallel to the longitudinal axis of the metal chassis (3). The skilled artisan will readily appreciate that it is convenient to configure the input lever (13) and the hinged link arms (15, 16, 17 & 18) such that input movement is substantially normal to the resultant movement for ease of access to the input lever (13). The apertures (21, 22) in each of the input levers (13) are used to fit any convenient intermediate integer (not shown) selected for applying the input force to their respective input lever (13).

Referring to FIG. 2, the intermediate integers chosen for the present embodiment are a series of adjuster blocks (10) individually fixed to each of the input levers. Grub screws (9) threadedly engaged with the metal chassis (3) to bear against each of the adjuster block (10).

This arrangement allows precise alignment of the modules (2) by reducing the axial input motion of the grub screw (9) by ratio of about 1000 to 1 to produce minute movement of the engagement plate (19) with respect to the metal chassis (3).

The invention has been described herein by way of example only. Skilled workers in this field will readily recognise many variations and modifications that do not depart from the spirit and scope of the broad inventive concept.

The invention claimed is:

1. A modular printhead comprising:

a chassis;

a plurality of printhead modules mounted in the chassis, each printhead module having an ink feed structure and a micro-electromechanical printhead integrated circuit mounted on the ink feed structure to receive ink from the ink feed structure; and a plurality of alignment mechanisms corresponding with respective printhead modules and interposed between the chassis and said respective printhead modules, each alignment mechanism including a lever coupled to an adjustment mechanism at a first side of a fulcrum point of the lever and a printhead module engagement plate coupled to the lever at a second side of the fulcrum point of the lever and engaged with a corresponding printhead module, wherein the lever and the printhead module engagement plate are formed as a unitary piece, and each alignment mechanism further includes a number of hinged arms disposed between the printhead module engagement plate and the chassis, the hinged arms facilitating linear and parallel movement of the engagement plate in a direction towards and away from adjacent printhead modules in response to operation of the lever.

2. A modular printhead according to claim 1, wherein the fulcrum point is located closer to the printhead module engagement plate than to the first point.

3. A modular printhead according to claim 1, wherein each unitary piece is mounted to the chassis.

4. A modular printhead according to claim 3, wherein each adjustment mechanism comprises a rotatable member held fast with the chassis and threadedly coupled to the lever.

5. A modular printhead according to claim 4, wherein the rotatable member comprises a grub screw mounted to the chassis.

6. A printer including a modular printhead according to claim 1.

7. A modular printhead according to claim 1, wherein the chassis includes an elongate common supply reservoir for supplying ink to each of the plurality of printhead modules, the elongate common supply reservoir substantially spanning a width of the chassis.

8. A modular printhead according to claim 7, wherein each alignment mechanism moves the respective engagement plate independent of the elongate common supply reservoir.

9. A modular printhead according to claim 7, wherein each alignment mechanism moves the respective engagement plate relative to the elongate common supply reservoir.

10. A modular printhead according to claim 1, wherein the hinged arms effect linear and parallel movement of the engagement plate along a longitudinal axis of the chassis.

* * * * *